US005553726A

United States Patent [19]

Park

[11] Patent Number: 5,553,726

[45] Date of Patent: Sep. 10, 1996

[54] DRIPLESS FEEDER NIPPLE SYSTEM WITH DETACHABLE VALVE

[76] Inventor: Ki H. Park, 1721 Monarch Ridge Cir., El Cajon, Calif. 92019

[21] Appl. No.: 149,603

[22] Filed: Nov. 8, 1993

[51] Int. Cl.[6] ..... A61J 11/00

[52] U.S. Cl. ..... 215/11.4; 215/11.1

[58] Field of Search ..... 215/11.1, 11.3, 215/11.4, 11.5

[56] References Cited

U.S. PATENT DOCUMENTS

| | | | |
|---|---|---|---|
| 2,133,411 | 10/1938 | Zohe | 215/11.1 |
| 2,588,069 | 3/1952 | Allen | 215/11.1 |
| 2,708,421 | 5/1955 | Jauch | 215/11.4 X |
| 2,744,529 | 5/1956 | Tichy | 215/11.4 |
| 2,747,573 | 5/1956 | Schaich | 215/11.4 |
| 2,876,773 | 3/1959 | Witz | 215/11.4 |
| 3,346,133 | 10/1967 | Herdman | 215/11.1 |
| 3,704,803 | 12/1972 | Ponder | 215/11.4 X |
| 3,946,888 | 3/1976 | Tonkin | 215/11.5 |
| 4,320,883 | 3/1982 | Bass | 248/104 |
| 4,898,291 | 2/1990 | Sailors | 215/11.4 |
| 4,969,564 | 11/1990 | Cohen et al. | 215/11.1 |
| 5,035,340 | 7/1991 | Timmons | 215/11.4 |
| 5,040,756 | 8/1991 | Via Cava | 248/103 |
| 5,072,842 | 12/1991 | White | 215/11.4 |
| 5,101,991 | 4/1992 | Morifuji et al. | 215/11.4 X |

FOREIGN PATENT DOCUMENTS

| | | | |
|---|---|---|---|
| 84970 | 8/1921 | Austria | 215/11.1 |
| 384394 | 8/1990 | European Pat. Off. | 215/11.1 |
| 63500 | 7/1892 | Germany | 215/11.1 |
| 10524 | 3/1902 | Norway | 215/11.1 |
| 430185 | 6/1935 | United Kingdom | 215/11.1 |
| 9201435 | 2/1992 | WIPO | 215/11.4 |

*Primary Examiner*—Sue A. Weaver
*Attorney, Agent, or Firm*—Knobbe, Martens, Olson & Bear

[57] ABSTRACT

A feeder nipple system removably mounted on a container and has a nipple body with a nipple, and a detachable valve which prevents leakage from the nipple body. The detachable feature of the valve also permits proper sanitization of the feeder nipple system. The valve has a toroidal shaped top portion integrally joined by a truncated trapezoidal shaped neck of the valve to a toroidal shaped bottom portion of the valve which has a circular central portion having a slightly concave shape with slits which form a plurality of flaps. When the flaps are opened in the direction of a sucking force applied to the nipple, fluid flows out of the nipple body. However, when the flaps are closed, upon cessation of the applied sucking force, the fluid is prevented from leaking through the detachable valve and out of the nipple body. The nipple body, nipple, and detachable valve are made of pliable material which allows them to be easily deformable.

11 Claims, 2 Drawing Sheets

DRIPLESS FEEDER NIPPLE SYSTEM WITH DETACHABLE VALVE

BACKGROUND OF THE INVENTION

1. Field of the Invention

The present invention relates to a feeder nipple system, and more particularly, to a feeder nipple system which has a detachable valve within a nipple body to prevent fluid from dripping out of the nipple when not in use.

2. Description of the Related Technology

It is well known that bottles used to feed infants have nipples that leak milk when not in use. The prior art nipples often leak milk or other liquids on the infant, on bedding, on the infant's clothes, as well as on the person feeding the infant. Cloths are constantly required to wipe up spills on tables, the floor, clothing and other items on which milk or other fluids are dripped. If unnoticed, the fluid, particularly milk, will in a short time, become quite disagreeable because the milk sours quickly. The parent or other care provider must search out the spill and clean it. The need to constantly clean up spills due to leaky nipples is tiresome and disadvantageous.

Prior art devices which attempt to solve the problem of leaking fluids from a bottle typically involve complex modifications to standard nipples. These complex devices require multiple steps to manufacture, and numerous parts requiring costly assembly time. Therefore, the prior art devices are necessarily expensive to manufacture. Such devices are shown, for instance, by U.S. Pat. Nos. 3,946,888, 4,898,291, 5,040,756, 5,072,842, and 5,101,991. These prior art devices suffer the disadvantages of being inflexible in construction and complex in design.

Additionally, as exemplified by U.S. Pat. No. 3,946,888, no teaching is provided for preventing leakage from a nipple valve of the present baby feeding apparatus. Neither is there any suggestion that the valve be detachable.

In U.S. Pat. No. 5,040,756, a valve is disclosed which purports to be leak-proof. However, the apparatus described discloses a threaded coupling which screws onto a tube in an attempt to provide a leak-proof apparatus. The constant wear on the threads of the coupling due to continuous use can cause the threads to provide a leak path through the coupling and around the valve within the coupling. Therefore, the apparatus will begin to leak liquid after a period of time.

In addition, this reference describes the construction of the valve as flat, with a "Y" shaped cut made in the valve to create an opening for liquid flow. Unfortunately, this construction does not provide an optimized apparatus for allowing fluid to flow through the valve. Nor is this valve detachable to facilitate maintenance and sanitation of the valve. The other prior art devices referenced hereinabove also do not provide for detachable valves, nor do they provide for optimized fluid flow.

Therefore, there is a need for a baby feeding nipple providing a detachable valve within a nipple body, allowing for easy sanitation, and simultaneously providing an optimized apparatus for allowing fluid flow.

SUMMARY OF THE INVENTION

The above-mentioned disadvantages of the prior art devices are overcome by the present invention. Briefly stated, the preferred embodiment of the present invention provides a novel feeder nipple system which is leak-proof.

In one embodiment, the feeder nipple system includes several separate parts: a nipple which is integrally formed within a nipple body, a detachable valve which prevents leakage of fluid through the nipple, and a container on which is mounted the nipple body. The construction of the nipple, the nipple body, and the detachable valve allows for easy removal of the valve for sanitarily cleaning these separate parts. Preferably, the nipple, nipple body, and detachable valve are manufactured from a moldable rubber composition into a pliable shape to allow each of these parts of the feeder nipple system to be easily deformable.

Specifically, the nipple body has a first end and a second end. On the first end, the nipple has numerous apertures through which fluid flows to the user of the feeder nipple system. The numerous apertures in the nipple create multiple paths for fluid flow. More specifically, the nipple has multiple horizontal ribs preferably equally spaced and integrally formed along the length of an outer surface of the nipple. These multiple ribs provide a better gripping surface for the infant or other user. Preferably, the material used for the nipple is pliable and flexible to better simulate the natural feel of a nipple.

The second end of the nipple body is open and allows the nipple body to be mounted onto a container, such as a standard baby bottle. Specifically, the baby bottle is preferably manufactured to be easily manually grasped and held by a person. The second end of the nipple body also includes a foot which may be connected to the top of a baby bottle. Modifications may be easily made to the nipple body so that it may fit into any container top which has an open center. Alternatively, the present design of the nipple body is such that the foot can fit into existing container tops which have open centers. Preferably, the material of the nipple body is easily sanitized after use.

Another of the parts of the feeder nipple system is the detachable valve which has a top portion integrally joined by a neck to a bottom portion. The bottom portion of the valve has a plurality of slits which emanate radially from a center of the bottom portion toward a perimeter of the bottom portion. These slits form a plurality of flaps in the bottom portion, which preferably has four tangentially contiguous flaps. Specifically, the bottom portion has a slightly concave shape as viewed from the bottom portion of the valve to provide an improved flow of fluid towards the nipple. More specifically, the concave shape also permits an improved seal between the multiple flaps to prevent leakage from the nipple body when the feeder nipple system is not in use.

The detachable valve is insertable into the nipple body, yet is also detachable or removable as a separate piece from a mating portion of the nipple body. Friction holds the valve within the nipple body, until the valve needs to be removed for replacement or sanitizing. The valve neck has a height which is slightly less than the height of the mating portion of the nipple body. The mating portion requires that an external force be applied to insert the mating portion between the top portion and the bottom portion of the detachable valve. When this force is applied, both the top and bottom portion of the valve move slightly apart as the nipple body seats against the neck of the valve. The removable feature of the valve for sanitizing is important to prevent clogged nipple apertures and dried fluid residue from causing potential health problems.

An external downwardly applied manual force is applied to the nipple body to insert the detachable valve. When the force is applied, the mating portion of the nipple body is deformed. Simultaneously, the detachable valve is manually pushed upward against the mating portion of the nipple body. The mating portion of the nipple body forms itself into the matching mating portion of the neck in the detachable valve, between the top portion and the bottom portion of the valve. Hence, the mating force causes the nipple body to be sealed securely yet removably, against the neck of the valve.

To detach the valve, a manual pulling force must be applied to the detachable valve in a direction toward the second end of the nipple body. The top and bottom portions of the valve move apart slightly because the material is pliable in both the nipple body and the detachable valve. As the force is continuously applied, the mating portion of the nipple body deforms and slips away from the neck and out of the valve.

The feeder nipple system is used by applying a sucking force on the nipple end of the nipple body. Upon application of the sucking force, the flaps, which are normally in a closed position, open in the direction of the sucking force, thereby allowing the fluid to flow through and out of the nipple body. A slightly concave shape in the bottom portion is formed each time a sucking force is applied to the nipple. When the user stops sucking on the nipple, the flaps close, thereby preventing the fluid within the container from leaking through the removable valve.

The above-described method of use prevents the feeder nipple system from leaking or dripping fluid from the container. Although preferably designed to be used by infants, other possible applications of the novel feeder nipple system are use by the physically challenged or elderly. Also, the feeder nipple system can be used during hospital environments where sanitation is of paramount importance. In addition, the feeder nipple system can be used for safety purposes where users are unable to grasp or hold containers or are unable to feed themselves without risking injury. Therefore, the present invention prevents wasting of fluid or food, leakage of fluid on the user or clothing, allows for sanitary feeding of infants, and permits easy removal of the valve for sanitation purposes.

These and other objects and features of the present invention will become more fully apparent from the following description and appended claims taken in conjunction with the accompanying drawings.

DETAILED DESCRIPTION OF THE PREFERRED EMBODIMENTS

Figure 1:
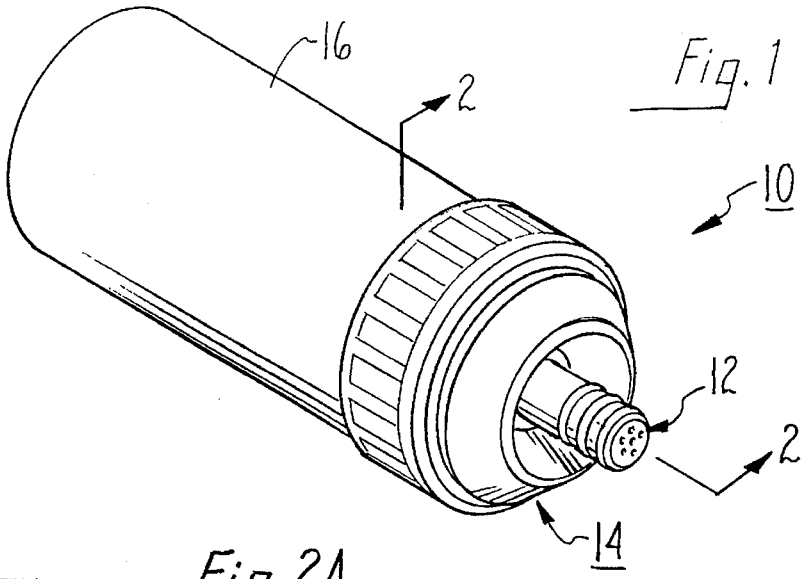
FIG. 1 is a perspective view of a preferred embodiment of a feeder nipple system, illustrating a nipple and a nipple body mounted on a container.

Reference is now made to the drawings wherein like numerals refer to like parts throughout. Referring initially to FIG. 1, the present invention of a leakproof feeder nipple system with detachable valve is generally referred to by reference designator 10. As shown in FIG. 1, the feeder nipple system 10, including a nipple 12, (which may also be defined as the "teat portion") is integrally manufactured into a nipple body 14 which is removably mounted on a container 16. The container 16 is manufactured to be easily grasped and held by a user of the feeder nipple system 10.

Figure 2A:
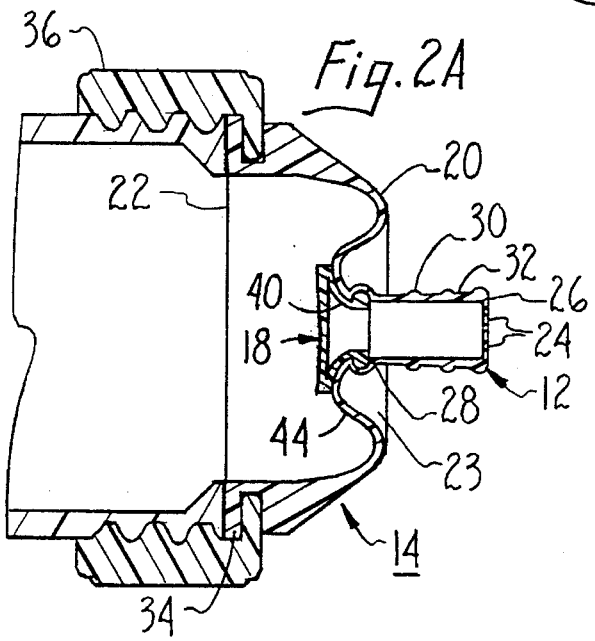
FIG. 2A is a partial cross-sectional view taken along line 2—2 of FIG. 1, showing a detachable valve in the nipple body in a normally closed position.

Referring now to FIG. 2A, a detailed partial cross-sectional view of the feeder nipple system 10 taken along line 2—2 of FIG. 1, shows a detachable valve 18 in a normally closed position in the nipple body 14. When in the closed position, the valve 18 prevents leakage of fluid through the nipple 12. The construction of the nipple 12, the nipple body 14, and the detachable valve 18 allows for easy removal of the valve 18 for cleaning and for providing proper sanitation of the different parts.

The feeder nipple system 10, including the detachable valve 18 is preferably manufactured from a moldable rubber composition to a pliable shape, thereby allowing the feeder nipple system 10 to be easily deformable. The nipple body 14 shown in FIG. 2A has a first end 20 and a second open end 22. The first end 20 has a cylindrical recessed opening 23 from which the nipple 12 protrudes. A plurality of apertures 24 in the nipple 12 allow fluid to flow when actuated by a user of the feeder nipple system 10. The apertures 24 provide multiple paths for the fluid to flow in greater volume to the user. The nipple 12 is manufactured to a shape of an inverted cylindrical truncated cone. In use, the upper end 26 of the nipple 12 is inserted into the mouth of a user, and is generally a planar circular surface with a larger diameter than the diameter of the opposite end 28 of the nipple 12. The nipple 12 has a plurality of horizontal ribs 30 generally equally spaced and extending along the length of the nipple 12. Also, the ribs 30 are integrally formed along a length of an outer surface 32 of the nipple 12. The horizontal ribs 30 help the user to securely grasp the nipple 12. Pliable and flexible materials are preferably used to manufacture the nipple 12 to better simulate a mother's natural nipple.

Referring again to FIG. 2A, the second end 22 of the nipple body 14 is open and allows the nipple body 14 to be mounted onto the container 16. The container 16 is a baby's bottle in the preferred embodiment of the present invention and is manufactured to be easily grasped and held by a person. The second end 22 of the nipple body 14 has a foot 34 which is adaptable to a container top 36. Preferably, the foot 34 is a circular washer integrally formed into the nipple body 14. Specifically, the thickness of the foot 34 is such that the nipple body 14 is easily yet firmly held by a threaded container top 36. However, the foot 34 is thin enough so that the nipple body 14 may be easily removed from the container top 36 for cleaning. The design of the nipple body 14 has the advantage of being easily adaptable to any container top 36 which has an open center. Alternatively, the present design of the nipple body 14 is such that the foot 34 can fit into existing container tops 36 having open centers. The material of the nipple body 14 is preferably of rubber composition. However, any material which is pliable and easily sanitized may be used.

As shown in FIG. 2A, the nipple body 14 has a mating portion 44 which is shaped to mate the nipple body 14 with the detachable valve 18 at the neck 40 of the valve 18.

Figure 2B:
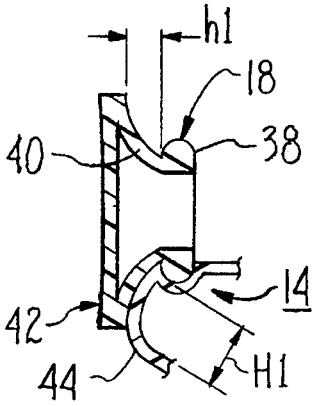
FIG. 2B is a detailed cross-sectional side view of the detachable valve shown in FIG. 2A, showing more clearly the relationship between the nipple body and the valve.

Referring now to FIG. 2B, a detailed side view of the detachable valve 18 illustrates more clearly the relationship between the nipple body 14 and the valve 18. The detachable valve 18 has a toroidal shaped top portion 38 integrally joined by a truncated trapezoidal shaped neck 40 to a toroidal shaped bottom portion 42.

As shown in FIG. 2B, the neck 40 of the nipple body 14 has a height h1. The mating portion 44 of the nipple body 14 is designed to have a slightly greater height H1. Preferably, the height h1 of the neck 40 is about 0.12 inches, while the height H1 of the mating portion 44 of the nipple body 14 is about 0.19 inches. Specifically, the mating portion 44 requires that an external downward force be applied to insert the mating portion 44 between the top and the bottom portions 38,42 of the valve 18. The force results in deformation of the mating portion 44, thereby permitting the nipple body 14 to seat securely, yet removably, against the valve 18. When the force is applied in this manner, both the top and bottom portions 38,42 of the valve 18 move slightly apart as the nipple body 14 seats against the neck 40 of the valve 18. When the valve 18 is seated within the mating portion 44 of the nipple body 14, the bottom portion 42 of the valve 18 has a slightly concave shape. The concave shape ensures that fluid will more easily flow towards the nipple 12 when the nipple 12 is sucked on by a user.

Figure 2C:
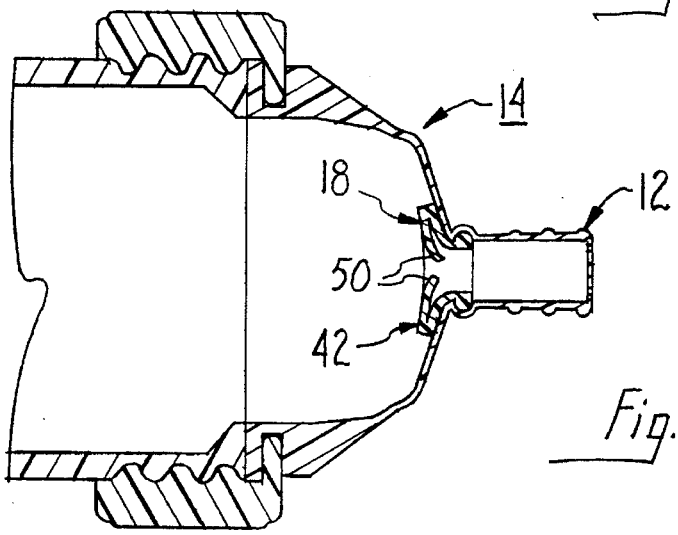
FIG. 2C is a detailed partial cross-sectional view taken along line 2—2 of FIG. 1, showing the detachable valve in the nipple body in an open position.

Referring now to FIG. 2C, a detailed partial cross-sectional view taken along line 2—2 of FIG. 1, shows the valve 18 within the nipple body 14 in an open position. As shown in FIG. 2C, a slightly concave shape is formed in the detachable valve 18 each time a sucking force is applied to the nipple 12. As more sucking force is applied to the nipple 12, a plurality of flaps 50 open in the valve 18 to allow fluid contained in the container 16 to flow through the nipple 12 to the user's mouth.

Figure 3A:
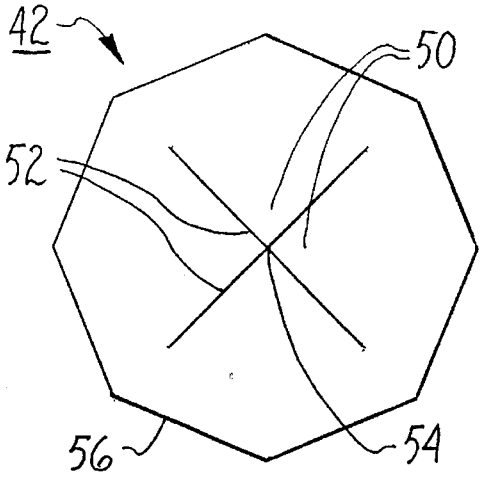
FIG. 3A is a detailed end view of the valve shown in FIG. 2B in the normal closed position, showing a plurality of flaps tangentially contiguous to each other.

Referring now to FIG. 3A, a detailed end view of the top portion 38 (shown in FIG. 2B) of the valve 18 in the normal closed position, shows the plurality of flaps 50 held tangentially contiguous to each other. The bottom portion 42 of the detachable valve 18 has a plurality of slits 52 which emanate radially from a center 54 of the bottom portion 42 toward a perimeter 56 of the bottom portion 42. However, the slits 52 do not terminate on the perimeter 56. The slits 52 form the plurality of flaps 50 in the bottom portion 42 of the detachable valve 18. An octagonal perimeter 56 is shown in FIG. 3A. However, the perimeter 56 of the valve 18 may have other convenient shapes, including a circular shape.

Referring again to FIG. 3A, the bottom portion 42 preferably has four flaps 50. However, the bottom portion 42 may have any convenient number of tangentially contiguous flaps 50. In another embodiment of the present invention (not shown), six slits 52 are made in the bottom portion 42, creating three pairs or six flaps 50. The concave shape of the valve 18 permits a better seal between the multiple flaps 50. This seal prevents leakage from the nipple body 14 when the feeder nipple system 10 is not in use. The flaps 50 are preferably manufactured from a resilient material, such as rubber, with a memory such that the flaps 50 are in the normally closed configuration of FIG. 3A. A change in air pressure may create a differential pressure between opposite surfaces of the flaps 50. The concave shape of the valve 18 prevents fluid flow unless a sufficiently strong differential pressure is created, as caused by a user sucking on the nipple 12.

Figure 3B:
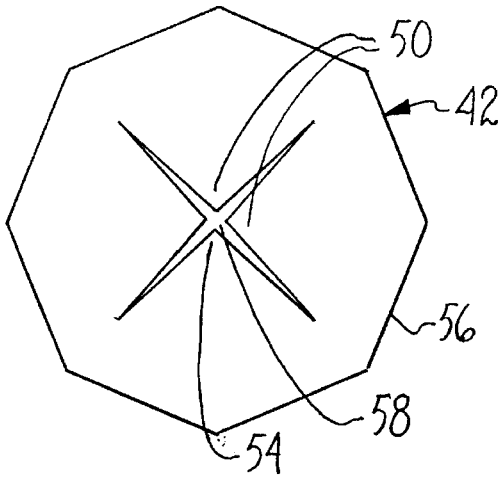
FIG. 3B is a detailed end view of the valve shown in FIG. 2C in the open position, showing an opening in a center of the valve between the flaps.

Referring now to FIG. 3B, a detailed end view of the bottom portion 42 of the valve 18 is shown in the open position. An opening 58 is shown in the center 54 of the valve 18 between the flaps 50. This opening occurs when a user, such as an infant, sucks on the nipple 12 (shown in FIG. 1, 2A and 2C) with sufficient force to cause the flaps 50 to be displaced toward the nipple 12. The opening 58 also permits fluid to flow to the user when the nipple 12 is thereby actuated.

Figure 4:
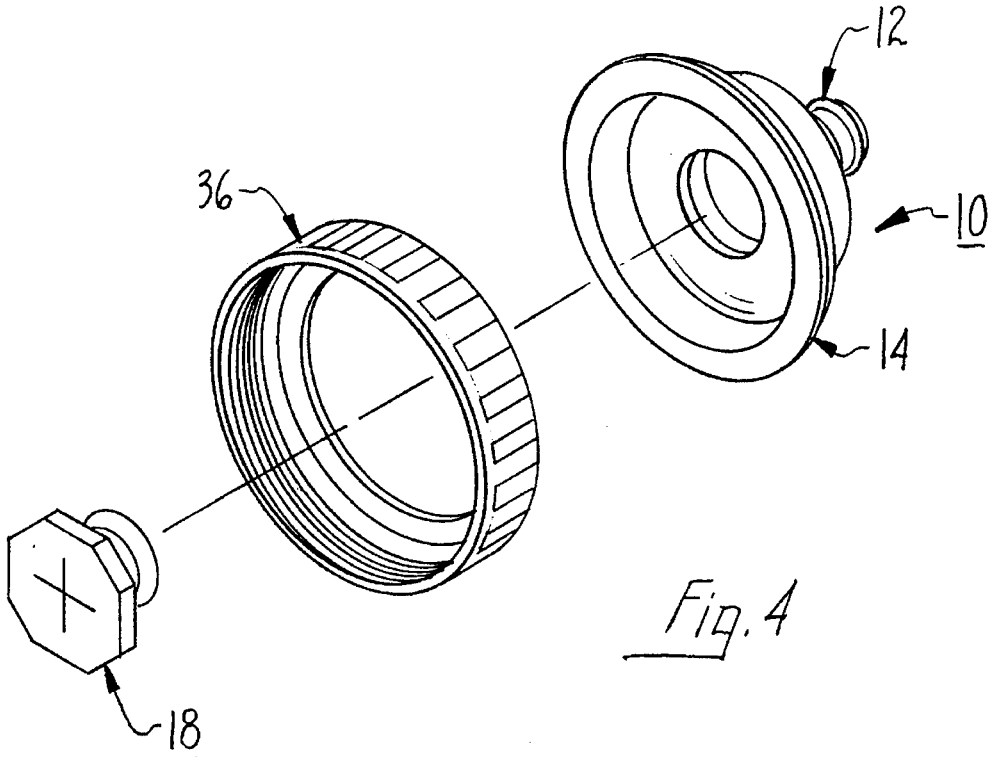
FIG. 4 is an exploded perspective view, showing the valve as detachable from the nipple body and from a container top shown in FIG. 1.

Referring now to FIG. 4, an exploded perspective view, shows the valve 18 as detachable from the nipple body 14 and from the container top 36. The detachable feature of the valve 18 allows the valve 18 to be cleaned after use. Use of the feeder nipple system 10 with milk or other foods results in the nipple 12, the nipple body 14, and the detachable valve 18 becoming contaminated and unsanitary. Therefore, the user, such as an infant, may become ill if the feeder nipple system 10 and valve 18 are not kept in a sanitary condition.

Referring simultaneously to FIGS. 2 and 4, the following steps are required to insert and detach the nipple body 14 from the feeder nipple system 10. To insert the detachable valve, an external downward force is first applied to the nipple body 14. When this force is applied, the mating portion 44 of the nipple body 14 is deformed outwardly. Simultaneously, the detachable valve 18 is pushed upward against the mating portion 44 of the nipple body 14. Because of the pliable material used in the construction of both the nipple body 14 and the detachable valve 18, the mating portion 44 of the nipple body 14 forms itself into the neck 40 in the detachable valve 18, between the top portion 38 and the bottom portion 42 of the valve 18. The force results in seating the nipple body 14 securely, yet removably, against the neck 40 of the valve 18.

To detach the detachable valve 18 after use, a manual pulling force is first applied to the detachable valve 18 in a direction toward the open second end 22 of the nipple body 14. The top and bottom portions 38,42 of the valve 18 move slightly apart because the material of both the nipple body 14 and the detachable valve 18 is pliable. As the pulling force is continuously applied, the mating portion 44 of the nipple body 14 deforms and slips away from the neck 40 and out of the valve 18. Now, the detachable valve 18 and the nipple body 14, with the integral nipple 12, are detached and may be cleaned prior to their next use.

Referring simultaneously to FIGS. 1 and 2, a method of use of the feeder nipple system 10 is now described. A sucking force is applied by a user to the nipple 12 of the nipple body 14. The flaps 50, normally in a closed position, are opened due to the application of a sucking force. The flaps 50 are opened in the direction of the sucking force, thereby allowing the fluid to flow through and out of the nipple body 14 and through the nipple 12. Next, ceasing the sucking force results in the flaps 50 becoming closed, thereby preventing the fluid within the container 16 from leaking through the detachable valve 18.

Although preferably used by infants, other possible uses of the novel feeder nipple system 10 are for the physically challenged or others who are unable to feed themselves without difficulty. In addition, the feeder nipple system 10 can be used in hospital environments when sanitation is paramount.

Still another application of the nipple system 10 is for animal feeding. Young nursing age animals may easily be fed with the present invention. The nipple system 10 may be manually held by a person to feed nursing animals or secured upside down to a structure so that an animal may feed itself. When suction is applied to the nipple, fluid is dispensed on demand. Other possible applications include providing a suction source other than the mouth of a user. For example, a motor driven apparatus may draw a vacuum on a hose connected to the nipple 12 using the nipple system 10. As fluid flows through the hose, the fluid may be dispensed to a patient in a regulated manner using a suitably adapted system.

While the above-detailed description has shown, described and pointed out the fundamental novel features of the invention as applied to various embodiments, it will be understood that various omissions and substitutions and changes in form and details of the device illustrated may be made by those skilled in the art, without departing from the spirit of the invention.

What is claimed is:

1. A feeder nipple system attachable to a container, wherein said container is used for holding a fluid, wherein said feeder nipple system comprises:

a nipple body removably attached to said container, said nipple body comprising a first end, a second end, and a mating portion connected to said first end;

a teat portion having a first and second end, said second end having a plurality of apertures, said first end of said teat portion connected to said first end of said nipple body;

a detachable valve removably connected to said mating portion of said nipple body, so as to allow fluid flow from the container to the teat portion when a sucking force is applied, and prevent leakage of fluid through said teat portion when the teat portion is not in use and to permit cleaning of said valve; and mating free formed seating elements on said first end of said teat portion and said valve to hold said valve in a specific location at said teat portion first end.

2. The feeder nipple system as defined in claim 1, wherein said teat portion defines an inverted cylindrical truncated cone.

3. The feeder nipple system as defined in claim 2, wherein the second end of said teat portion is generally a planar surface with a larger diameter than the first end of said teat portion.

4. The feeder nipple system as defined in claim 3, wherein said teat portion has a plurality of horizontally extending ribs generally spaced and integrally formed along a length of an outer surface of said teat portion.

5. The feeder nipple system as defined in claim 1, wherein said detachable valve comprises a toroidal shaped top portion integrally joined by a truncated trapezoidal shaped neck of the valve to a toroidal shaped bottom portion of the valve.

6. The feeder nipple system as defined in claim 5, wherein said feeder nipple system is manufactured from a moldable rubber composition to a pliable shape, said pliable shape allowing said feeder nipple system to be easily deformable.

7. The feeder nipple system as defined in claim 5, wherein said neck has a relaxed axial extension which is less than the relaxed axial extension of said mating portion of said nipple body, wherein said mating portion requires an externally downwardly applied manual force to insert said mating portion between said top portion and said bottom portion of said valve, said force resulting in deformation of said mating portion to permit said nipple body to seat securely, yet removably, against said valve, such that when said force is applied, said top and said bottom portion of said valve move slightly apart as said nipple body seats against said neck of said valve.

8. The feeder nipple system as defined in claim 1, wherein said valve comprises a circular central portion having a plurality of slits, wherein said slits form a plurality of flaps in said central portion.

9. The feeder nipple system as defined in claim 8, wherein said slits emanate radially from a center of said central portion a finite distance toward a perimeter of said central portion.

10. The feeder nipple system as defined in claim 8, wherein said plurality of flaps comprises four tangentially contiguous flaps.

11. The feeder nipple system as defined in claim 8, wherein said central portion has a slightly concave shape as viewed from said bottom portion of said valve.

* * * * *